US008656962B2

(12) United States Patent
Oppl

(10) Patent No.: US 8,656,962 B2
(45) Date of Patent: Feb. 25, 2014

(54) GRIPPER HEAD OF A WEAVING MACHINE

(75) Inventor: Othmar Oppl, Hergensweiler (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 13/387,769

(22) PCT Filed: Jul. 6, 2010

(86) PCT No.: PCT/DE2010/000775

§ 371 (c)(1),
(2), (4) Date: Jan. 30, 2012

(87) PCT Pub. No.: WO2011/018062

PCT Pub. Date: Feb. 17, 2011

(65) Prior Publication Data

US 2012/0125475 A1 May 24, 2012

(30) Foreign Application Priority Data

Aug. 11, 2009 (DE) ..... 10 2009 037 127

(51) Int. Cl.
*D03D 47/23* (2006.01)
*D03D 47/39* (2006.01)
*D03D 47/20* (2006.01)

(52) U.S. Cl.
USPC ..... 139/448; 139/116.1; 139/438; 139/450

(58) Field of Classification Search
USPC ..... 139/116.1, 438, 439, 444–449, 450, 139/188 R, 189–193
See application file for complete search history.

(56) References Cited

U.S. PATENT DOCUMENTS 3,665,975 A * 5/1972 Kokkinis ..... 139/446
3,717,182 A * 2/1973 Sparling ..... 139/446
3,927,699 A 12/1975 Volpe
3,998,251 A 12/1976 Hadam
4,040,454 A 8/1977 Genini
4,188,980 A * 2/1980 Muller ..... 139/1 R (Continued)

FOREIGN PATENT DOCUMENTS

DE 528 345 6/1931
DE 553 886 7/1932

(Continued)

OTHER PUBLICATIONS

PCT, International Search Report of the International Searching Authority for International Application PCT/DE2010/000775, mailed Nov. 4, 2010, 2 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

A gripper head of a weaving machine has a clamping device for clamping a band-shaped weft material to be inserted into a loom shed of the weaving machine. The clamping device includes a stationary clamping jaw and a movable clamping jaw that is loaded by a spring and movable about a rotation axis. Each clamping jaw respectively has a clamping surface. The movable clamping jaw is actuatable by a control device to open the clamping device. The gripper head includes a frame, and the clamping surfaces are arranged essentially outside of the frame, but the spring and the rotation axis are arranged inside the frame.

17 Claims, 3 Drawing Sheets

(56) References Cited

U.S. PATENT DOCUMENTS

| | | | | | |
|---|---|---|---|---|---|
| 4,540,028 | A | * | 9/1985 | Gehring et al. | 139/453 |
| 4,558,722 | A | * | 12/1985 | Gehring et al. | 139/446 |
| 4,699,183 | A | * | 10/1987 | Menzel | 139/449 |
| 4,785,856 | A | * | 11/1988 | Gehring et al. | 139/453 |
| 4,905,741 | A | * | 3/1990 | Wahhoud et al. | 139/435.6 |
| 4,919,171 | A | * | 4/1990 | Dornier | 139/435.1 |
| 4,922,970 | A | * | 5/1990 | Gehring et al. | 139/446 |
| 4,958,664 | A | * | 9/1990 | Oppl et al. | 139/435.1 |
| 5,088,525 | A | * | 2/1992 | Zimmermann | 139/188 R |
| 5,183,084 | A | * | 2/1993 | Moeneclaey | 139/449 |
| 5,303,747 | A | * | 4/1994 | Arndt et al. | 139/449 |
| 5,455,107 | A | | 10/1995 | Homma et al. | |
| 5,566,725 | A | * | 10/1996 | Jaeger | 139/446 |
| 5,664,609 | A | * | 9/1997 | Herrlein et al. | 139/192 |
| 6,026,865 | A | | 2/2000 | Krumm et al. | |
| 6,382,262 | B1 | * | 5/2002 | Herzig | 139/50 |
| 7,992,596 | B2 | | 8/2011 | Khokar | |
| 8,129,294 | B2 | | 3/2012 | Khokar | |
| 2006/0169347 | A1 | | 8/2006 | Wahhoud | |
| 2008/0257443 | A1 | | 10/2008 | Khokar | |
| 2009/0007981 | A1 | | 1/2009 | Khokar | |
| 2009/0065090 | A1 | | 3/2009 | Bachofen et al. | |
| 2012/0125476 | A1 | | 5/2012 | Laukamp et al. | |

FOREIGN PATENT DOCUMENTS

| | | |
|---|---|---|
| DE | 645 465 | 5/1937 |
| DE | 25 17 011 | 5/1976 |
| DE | 25 41 990 | 8/1976 |
| DE | 299 08 543 | 8/1999 |
| EP | 0 240 075 | 10/1987 |
| EP | 0 863 237 | 9/1990 |
| EP | 1 803 843 | 7/2007 |
| EP | 2 037 023 | 3/2009 |
| GB | 2 072 718 | 10/1981 |
| WO | WO2006/075961 | 7/2006 |
| WO | WO 2008/009332 | 1/2008 |

OTHER PUBLICATIONS

PCT, PCT International Preliminary Report on Patentability including English Translation of PCT Written Opinion of the International Searching Authority for International Application PCT/DE2010/000775, issued Feb. 14, 2012, 9 pages, International Bureau of WIPO, Geneva, Switzerland.

* cited by examiner

GRIPPER HEAD OF A WEAVING MACHINE

FIELD OF THE INVENTION

The present invention relates to a gripper head of a weaving machine with a clamping device for a band-shaped weft material that is to be inserted into a loom shed of the weaving machine, wherein the clamping device comprises a fixed or stationary clamping jaw and a clamping jaw that is movable about a rotation axis and that is loaded by a spring, with each clamping jaw respectively having a clamping surface. The movable clamping jaw is actuatable by a control means for opening the clamping device. The invention further relates to a weaving machine with a corresponding gripper head.

BACKGROUND INFORMATION

Gripper heads have become known in various embodiments in the state of the art. The gripper heads comprise a clamping device in which the end of a weft thread is clamped and inserted into the loom shed. The opening of the clamping device can, for example, be carried out via a control rail in the area of the cloth edge or fell, or magnetically. The DE 25 17 011 B1 and the DE 299 08 543 U1, which describe such gripper heads, are for use with a thread-shaped weft material, whereby the weft material is presented to the gripper head lying obliquely or sloping in order to be clamped between the clamping surfaces of the clamping device. The mentioned gripper heads are not suitable for band-shaped weft materials, because these can be damaged by the oblique clamping in the clamping device.

The U.S. Pat. No. 5,455,107 shows a gripper head with a clamping device, which is to be suitable also for band-shaped weft materials. The free end of the weft material is clamped in a clamp that is fixedly arranged on the weaving machine, and is presented to the gripper head by a feeder that is movable in the warp direction along the cloth edge. The weft material is presented to the gripper head at an angle, similarly like with the above described devices, so that it can lead to damages especially with weft bands that contain reinforcing fibers.

The WO 2006/075961 A1 shows an insertion element which is suitable for the insertion of a band-shaped weft material and comprises a comparatively wide clamping device, which can clamp a band-shaped weft material in a straight stretched condition. The insertion element can be embodied as a gripper head or also as a projectile. The weft band is inserted into the loom shed in a conventional manner by means of the insertion element, and is then conveyed to the interlacing point by means of two clamps which are arranged in the area of the cloth edges and which are movable in the warp direction. A damage of the weft material by a conventional weft beat-up is hereby avoided. In connection with an excess swinging or over-shooting of the insertion element beyond the provided transfer position, under certain circumstances it can lead to damages of the weft material.

Further documents that show gripper heads are the DE 6 45 465 A, the DE 25 41 990 A1 as well as the EP 20 37 023. However, none of the gripper heads shown here is suitable for inserting band-shaped weft materials with a larger width into a loom shed without damages.

SUMMARY OF THE INVENTION

It is the object of the present invention to propose a gripper head which makes possible a reliable clamping of a band-shaped weft material and avoids damages of the weft material.

A gripper head of a weaving machine comprises a clamping device for a band-shaped weft material that is to be inserted into a loom shed of the weaving machine. In the context of this application, weft materials with a width in the range from 3 mm to 50 mm are understood to fall under the term band-shaped weft materials. Similarly, band-shaped materials or also conventional warp threads can come into use in the warp. The clamping device includes a fixed or stationary clamping jaw and a clamping jaw that is movably supported about a rotation axis and loaded by a spring. The clamping jaws each respectively comprise a clamping surface. The movable clamping jaw is actuatable by a control means for opening the clamping device. According to the invention it is provided that the gripper head comprises a perimeter frame, whereby the clamping surfaces are arranged outside of the frame and the spring and the rotation axis as well as a bearing arrangement of the movable clamping jaw are arranged within the frame. Through the inventive embodiment of the gripper head with a perimeter frame, it is possible to apply a comparatively large clamping force uniformly over the entire clamping width, because these can be supported via the bearing arrangement of the movable clamping jaw on the stable or sturdy frame. Hereby, a canting or tilting of the clamping jaws and therewith an only insufficient clamping of a band-shaped weft material is avoided. Through the inventive embodiment with a perimeter frame as well as clamping surfaces arranged outside of the frame, it is simultaneously possible to arrange the clamping mechanism and the bearing arrangement in a protected manner within the frame, so that these are protected from soiling or contamination, for example by fly lint or fiber fly.

Preferably, the clamping jaws comprise protruding collars, which extend outside of the frame perpendicularly to the motion direction of the gripper head in the direction of the interlacing point, and on which the clamping surfaces are arranged. Due to the protruding collars it is possible to arrange the clamping surfaces spatially separated and, with respect to the warp direction, laterally next to the clamping mechanism as well as a connection for a gripper rod or rapier. In the event of an over-swinging or over-shooting of the gripper head, hereby the collision of the free end of the weft material on parts of the gripper head as well as damages resulting therefrom are avoided. Additionally, by means of the protruding collars it is possible to arrange the clamping surfaces as close as possible to the interlacing point, while the components which require a comparatively large structural space are arranged in an area facing away from the interlacing point. Hereby the weft material can be inserted close to the interlacing point, so that no conventional weft beat-up, which would damage the weft material, is necessary.

Furthermore it is advantageous if the protruding collars, at least at their end facing toward the interlacing point, comprise a reduced structural height relative to a height of the frame. Hereby, the protruding collars with the clamping surfaces, which lie in the area of the acutely tapering loom shed, with respect to the shed cross-section, can be embodied comparatively thin, while nonetheless a stable or sturdy embodiment of the gripper head is made possible by the frame.

It is especially advantageous if the protruding collars comprise an essentially triangle-shaped contour, with respect to a shed cross-section or in the warp direction, because these hereby are given a warp deflecting shape, so that damages of the warp threads are avoided. Hereby it is especially advantageous if the cross-sectional shape of the protruding collars and/or of the gripper head is adapted to an opening angle of the loom shed, because the gripper head with the protruding collars can then carry out the weft insertion very close to the interlacing point, without leading to damages of the warp threads. Hereby it is possible to omit weft beat-up means or other means in order to bring the inserted band-shaped weft material against the interlacing point.

An advantageous embodiment of the invention provides that the frame is closed at its front end with respect to the motion direction of the gripper head. Hereby, the stability or sturdiness of the gripper head is substantially increased. Depending on the utilized material as well as the weight of the gripper head it is also possible, however, that the frame is embodied open at its front end.

An advantageous further development of the invention provides that the frame is formed by the stationary clamping jaw, and the movable clamping jaw is supported in the interior of the frame. Hereby a compact construction of the gripper head can be achieved.

It is especially advantageous if the movable clamping jaw is arranged completely within a longitudinal contour of the frame when the clamping device is closed. Because no parts of the movable clamping jaw, of the clamping device or of the bearing arrangement protrude outwardly beyond the longitudinal contour, thereby damages of the warp threads can be avoided despite the weft insertion near the interlacing point. For this, the longitudinal contour of the frame is embodied substantially smooth or flat without interruptions or steps.

It is further especially advantageous if the frame is embodied as a warp deflector. For this, the frame comprises sloped or beveled portions in its motion direction, so that it parts and deflects the warp threads during the weft insertion.

Furthermore, the frame can comprise a slope or bevel in the direction of the interlacing point, in order to achieve a warp deflecting shape also in the warp direction.

Besides that it is advantageous if the frame comprises securing bores for securing a gripper rod. The gripper rod, which similarly requires a somewhat larger structural space, is hereby similarly arranged in an area facing away from the interlacing point and thereby makes possible the insertion of the band-shaped weft material near the interlacing point.

According to a different advantageous further development of the invention, the movable clamping jaw is embodied as a one-armed lever and is thus actuated at its front end with respect to the motion direction of the gripper head. For this, at its front end, the clamping jaw comprises an actuating surface for the control means, especially a control rail. Hereby it is possible to trigger the opening of the clamping device as early as possible during the motion of the gripper head out of the loom shed, so that the free end of the band-shaped weft material can be clamped close to the cloth edge. For actuating the movable clamping jaw it is advantageous if the frame comprises a recess though which the actuating surface is actuatable by the control means. It is especially advantageous if the movable clamping jaw is actuatable directly at its front end in order to achieve the earliest possible opening of the clamping device.

A different advantageous embodiment of the invention provides that the movable clamping jaw is loaded by a leaf spring, which is loosely supported in the frame. Due to the embodiment of the spring as a leaf spring, a very compact and flat structural configuration of the gripper head can be achieved, which similarly facilitates the insertion close to the interlacing point. Because no securing means at all are necessary for the leaf spring, the structural height of the gripper head can be further reduced. Preferably the leaf spring is supported in a three-point bearing arrangement, whereby a central bearing point of the three-point bearing arrangement is arranged on the movable clamping jaw in a rotation axis of the clamping jaw. Hereby the leaf spring can be fixed between the two clamping jaws already simply by the shape of the movable clamping jaw.

Furthermore it is advantageous if the pre-tension of the spring is adjustable. The adjusting of the pre-tension can be carried out, for example, by means of an eccentric cam. The clamping force of the clamping device can thus be optimally adjusted to the band-shaped weft material being used as well as to the speed of the gripper head during its motion, so that a secure clamping of the band material can always be achieved.

According to a different further development of the invention it is provided that the gripper head comprises a guide element, by means of which it is guided on a weaving reed of the weaving machine. The guide element can, for example, be embodied as a slider, which slides along on the weaving reed during the weft insertion and hereby achieves a guidance of the gripper head in the weft direction. Especially it is advantageous if the gripper head is guided exclusively on the weaving reed of the weaving machine by means of the guide element at least within the loom shed or between the cloth edges. For this, the guide element and the weaving reed can be connected, for example, by means of a dovetail guide, so that the gripper head is guided in the horizontal and vertical direction and damages of the warp threads can be avoided. For this, the weaving reed of the weaving machine comprises a guide groove, in which the gripper head is guided by means of the guide element.

BRIEF DESCRIPTION OF THE DRAWINGS

Further advantages of the invention will be described in connection with the following illustrated example embodiments, wherein.

DETAILED DESCRIPTION OF EXAMPLE EMBODIMENTS OF THE INVENTION

Figure 1:
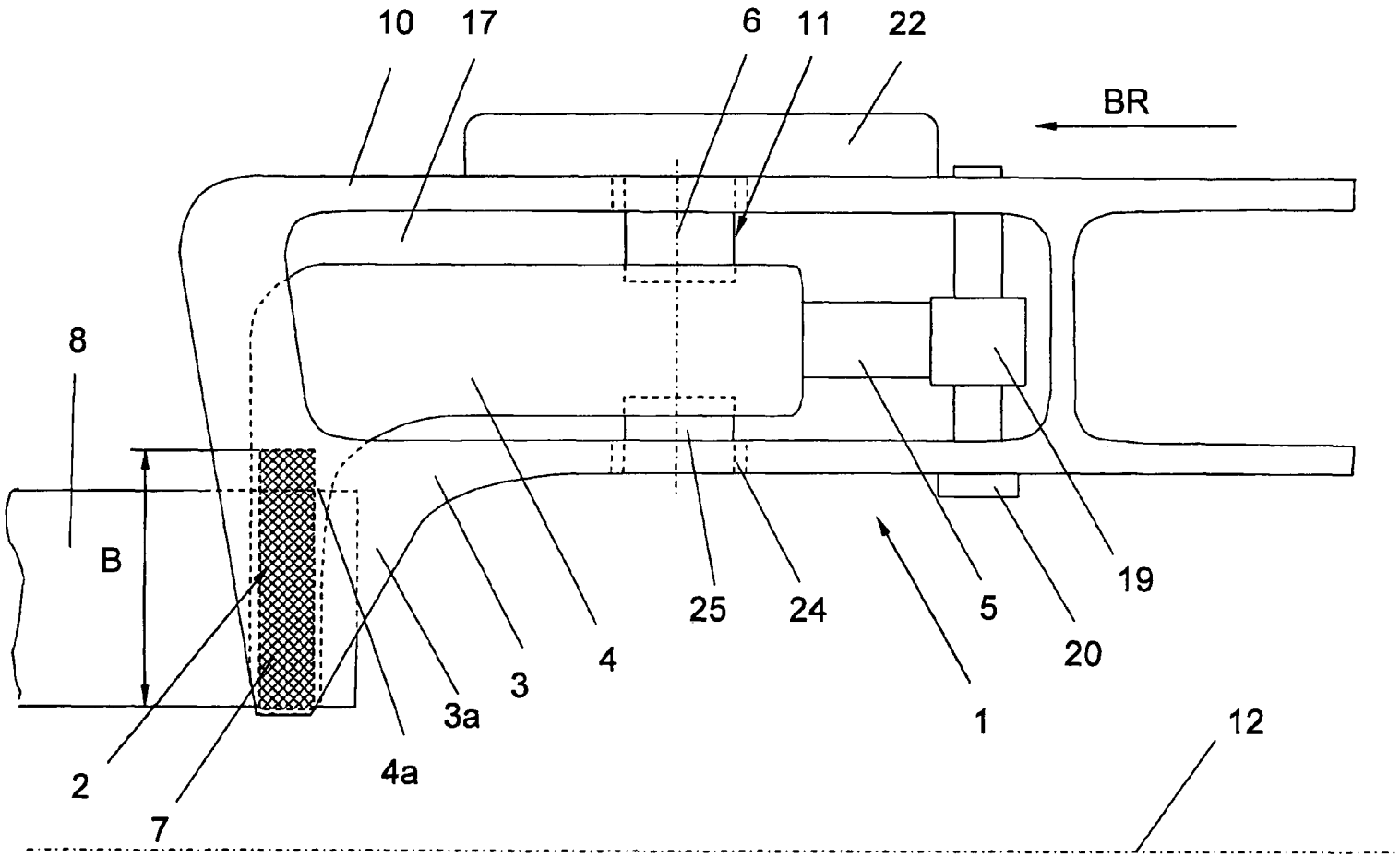
FIG. 1 shows a gripper head according to the invention in a schematic top plan view.

FIG. 1 shows a gripper head 1 according to the invention in a schematic top plan view. The gripper head 1 includes a clamping device 2 with a fixed or stationary clamping jaw 3 as well as a movable clamping jaw 4. The movable clamping jaw 4 is loaded by a spring 5, presently a leaf spring 5, and is rotatably supported about a rotation axis 6. The clamping jaws 3 and 4 respectively comprise a clamping surface 7, between which a band-shaped weft material 8 that is to be inserted into a loom shed of a weaving machine, which is not illustrated here, can be clamped. For opening the clamping device 2 against the spring force, the movable clamping jaw 4 is actuatable by a control means 9 that is not shown here (see FIG. 3).

According to the invention, the gripper head 1 comprises a perimeter frame 10, which presently is formed by the stationary clamping jaw 3. Because the frame 10 is formed by the stationary clamping jaw 3, and the movable clamping jaw 4 is supported within the frame 10, it is possible to embody the movable clamping jaw 4 integrated in the stationary clamping jaw 3, and hereby to achieve an especially compact structural configuration of the gripper head 1 with a comparatively small structural height H.

Figure 2:
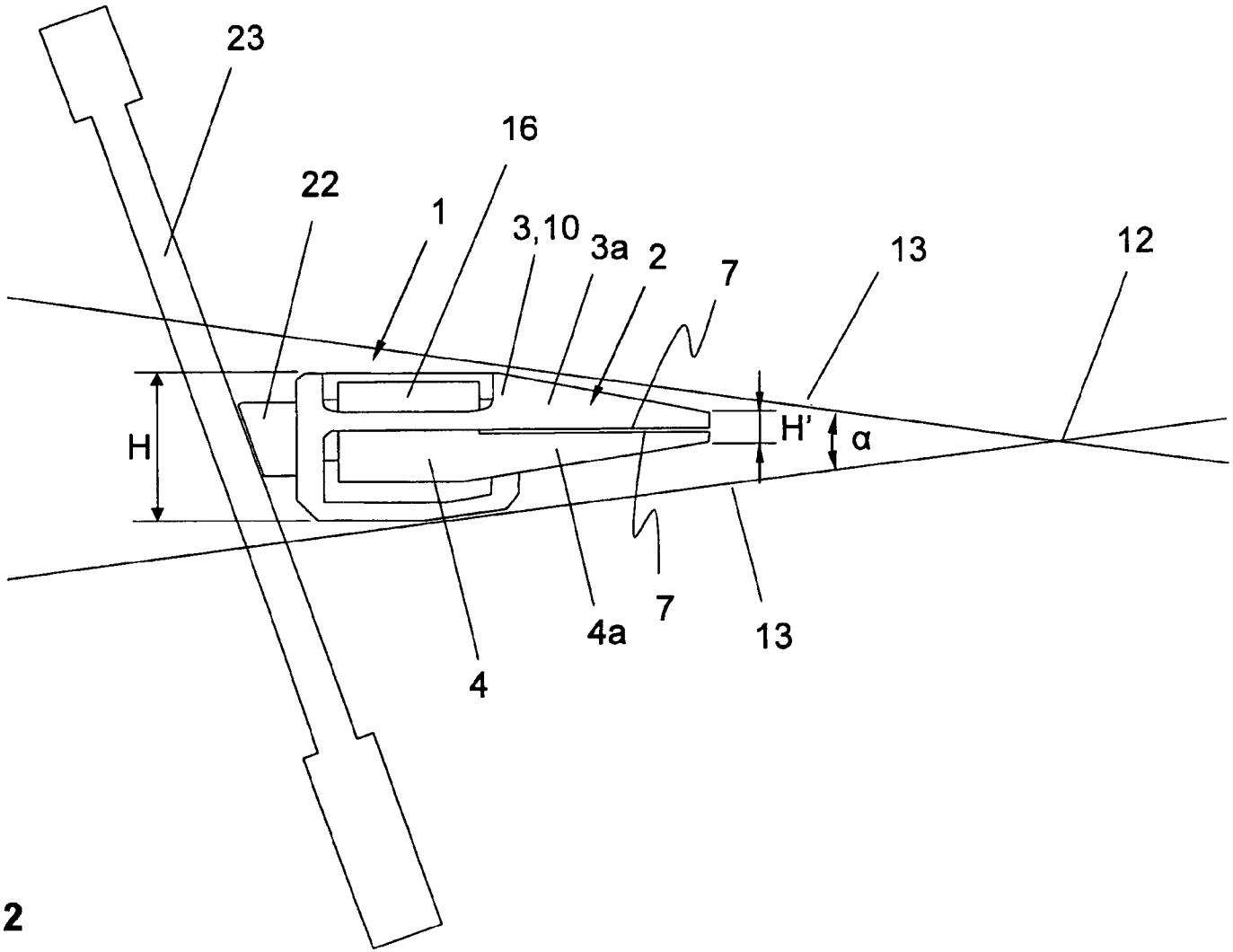
FIG. 2 shows a loom shed cross-section with a front view of the gripper head according to the invention.

The clamping surfaces 7 are arranged essentially outside of the frame 10, next to the frame 10 in the warp direction according to the present illustration (compare FIG. 2). The spring 5 as well as the clamping mechanism with the rotation axis 6 and a bearing arrangement 11 of the clamping jaw 4 are, however, arranged essentially within the frame 10. The frame 10 or respectively the stationary clamping jaw 3 thus forms a sort of housing in which the components of the bearing arrangements 11 and of the clamping mechanism of the clamping device 2 can be protected and compactly accommodated. The bearing arrangements 11 according to the present illustration include bearing bushings 24 which are set into the frame 10, and in which the movable clamping jaw 4 is supported via bearing bolts or studs 25.

Figure 3:
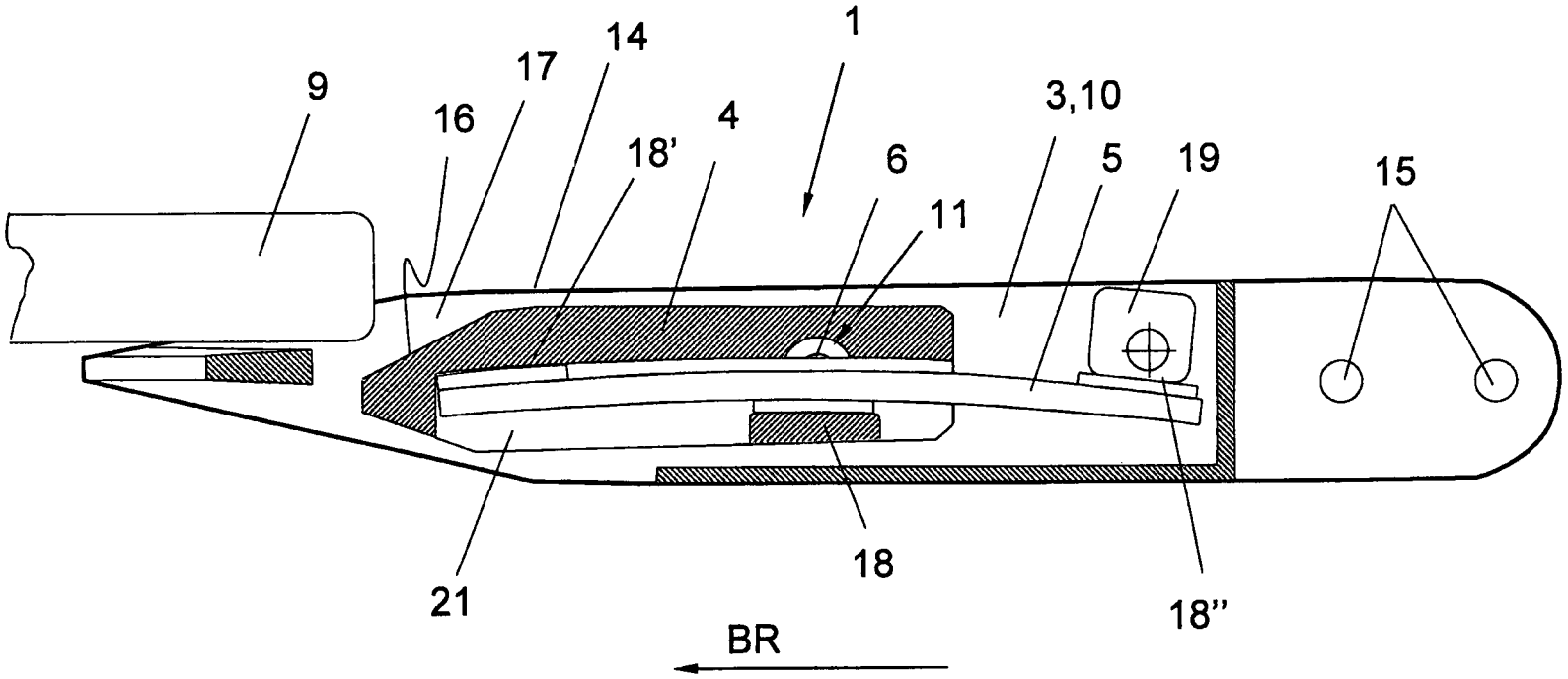
FIG. 3 shows a longitudinal section through a gripper head according to the invention with a leaf spring.

In order to achieve a protection against contaminations for example by fly lint, the frame 10 can also be embodied partly closed on its top and/or bottom side, as can be seen from FIG. 3, for example. Due to the embodiment of the gripper head 1 with a stable or sturdy perimeter frame 10, band-shaped materials can be reliably clamped over the entire clamping width B, because a canting or tilting of the clamping jaws 3, 4 is avoided by the stable frame 10. By the embodiment of the stationary clamping jaw 3 as frame 10, the movable clamping jaw 4 can be supported on both sides of its longitudinal extension, so that an especially advantageous supporting or bracing of the clamping forces can take place, because the spacing distance of the two bearing arrangements 11 can be embodied comparatively large with reference to the clamping width B. Simultaneously, the stable frame 10 makes possible an optimal adjustment of the clamping force. The clamping surfaces 7 can comprise a surface profiling or can be provided with an elastic underlayment so that a reliable clamping is possible even with a not exactly parallel orientation of the clamping surfaces 7 to one another.

At the front end of the gripper head 1 with respect to its motion direction BR, the clamping jaws 3 and 4 comprise protruding collars 3*a* and 4*a*, which extend outside of the frame 10 in the direction of the interlacing point 12, which is illustrated schematically here as a dash-dotted line. The clamping surfaces 7 are arranged in the area of the protruding collars 3*a*, 4*a*. Thus, by the inventive frame 10 and the protruding collars 3*a*, 4*a* it is possible to arrange the clamping surfaces 7 separate from the clamping mechanism with the spring 5 and its bearing arrangement (compare FIG. 3) and the bearing arrangements 11 of the movable clamping jaw 4. As can be seen in FIG. 1 and FIG. 2, the clamping surfaces 7 are hereby arranged laterally next to the frame 10 in the warp direction and thus close to the interlacing point 12, so that a weft insertion close to the interlacing point 12 or directly at the interlacing point 12 is possible.

For the weft insertion, the clamping device 2 of the gripper head 1 opens shortly after the gripper head 1 has left the loom shed, clamps the free end of the band-shaped weft material 8 and brings this through the loom shed to the oppositely located cloth edge. There the free protruding end is cut off close to the cloth edge. It is thus the goal to grasp or grip the band-shaped weft material 8 as close as possible to its free end, in order to keep the piece of the weft material 8 arising as waste at the opposite cloth edge as small as possible. Because the time point of the opening and closing of the clamping device 2 is adjusted during the creeping operation of the weaving machine, thus during operation at the operating rotational speed, it can lead to over-swinging or over-shooting of the gripper head 1 beyond the previously determined transfer position for the weft material 8. Because the entire clamping mechanism with the spring 5 and the bearing arrangements 11 are now arranged laterally next to the clamping surfaces 7 with respect to the warp direction and outside of the frame 10, a free swinging-through of the band-shaped weft material 8 is possible, so that damages of the weft material 8 by components of the bearing arrangement 11 or of the clamping mechanism can be avoided.

According to the present illustration, the frame 10 is closed by means of a web at its front end with respect to the motion direction BR of the gripper head 1, so that the gripper head 1 is embodied in an especially stable or sturdy manner. Depending on the utilized material it is, however, also possible to embody the frame 10 open at its front end. Thereby, the weight of the gripper head 1 can be further reduced.

As can be seen from FIG. 2, the protruding collars 3*a*, 4*a* comprise a reduced structural height H' in comparison to the structural height H of the frame 10 with respect to the loom shed cross-section illustrated in FIG. 2. This makes possible the clamping and insertion of the band-shaped weft material 8 close to the interlacing point 12, because the clamping surfaces 7 can be shifted in the direction of the interlacing point 12 due to the small structural height H' of the protruding collars 3*a*, 4*a*. The protruding collars 3*a*, 4*a* presently comprise an essentially triangle-shaped contour in the warp direction, so that damages of the warp threads 13 can be avoided despite the weft insertion close to the interlacing point 12. The contour of the protruding collars 3*a*, 4*a* as well as of the frame 10, respectively with respect to the loom shed cross-section, can be adapted to an opening angle $\alpha$ of the loom shed, so that the weft material 8 can be inserted nearly directly at the interlacing point 12. The opening angle $\alpha$ of the loom shed can hereby advantageously be embodied very small. Hereby the weft material 8, depending on the stability or the self-stiffness, can also be clamped in such a manner that it protrudes outwardly beyond the clamping surfaces 7 in the direction of the interlacing point 12, so that it can be inserted even closer to the interlacing point 12. Similarly, weft materials 8 of which the width is larger than the clamping width B of the clamping device 2 can also be clamped. Hereby, the weft material 8, especially with a sufficient stiffness, can be inserted still closer to the interlacing point 12.

FIG. 3 shows a longitudinal section in the motion direction BR of the gripper head 1, and illustrates the integrated structural configuration of the movable clamping jaw 4 with the stationary clamping jaw 3. The movable clamping jaw 4 is arranged completely within a longitudinal contour 14 (thick continuous line) of the stationary clamping jaw 3, at least when the clamping device 2 is closed. Besides a protected accommodation of the clamping mechanism and the bearing arrangements 11, hereby damages of the warp threads 13 are avoided, because no parts whatsoever of the clamping jaw 4, the bearing arrangement 11 or the spring 5 protrude outwardly beyond the longitudinal contour 14. Due to the embodiment of the gripper head 1 with a perimeter frame 10, the frame 10 or respectively the stationary clamping jaw 3 can furthermore be embodied as a warp deflector in an advantageous manner. As can be seen from FIG. 1, for this the frame 10 is sloped or beveled at its front end with respect to the motion direction BR in the area of the web, so that the warp separation or parting by the gripper head 1 takes place on the side of the gripper head 1 facing away from the interlacing point 12. As can further be seen from FIG. 3, the frame 10 additionally comprises a sloped or beveled portion in the motion direction BR of the gripper head 1, so that no damages of the warp threads 13 are to be expected even with a floating guidance of the gripper head 1 on the warp threads 13.

For operating the clamping device 2, a control means 9 is provided, which is presently embodied as a control rail, and which controls the opening and closing of the clamping device 2. The movable clamping jaw 4 is presently embodied as a one-armed lever, which comprises an actuating surface 16 for the control means 9 directly on its front end with respect to the motion direction BR of the gripper head 1. Hereby a very early opening of the clamping device 2 can be achieved, so that the free band end can be grasped very close or short, and hereby the waste of the weft material 8 can be reduced. Instead of a control rail, the control means 9 can also be formed by a pin or a cam or dog, which are arranged in the area of the cloth edge. A magnetic actuation is similarly possible. In order to make the actuating surface 16 accessible for the control means 9, the stationary clamping jaw 3 or the frame 10 comprises a recess 17 at least at its front end, through which recess the control means 9 can actuate the clamping jaw 4 integrated in the stationary clamping jaw 3.

As can further be seen in FIG. 3, the movable clamping jaw 4 is loaded by a spring 5, which is presently embodied as a leaf spring. Hereby the structural height H of the gripper head 1 can be maintained very small. The leaf spring 5 is supported loosely in the frame 10, that is to say without additional securing means and without a direct form-fitting connection. The leaf spring 5 simply supports itself at its front end, with respect to the motion direction BR of the gripper, on a bearing point 18' of the movable clamping jaw 4, while its rear end is supported on a bearing point 18" of the stationary clamping jaw 3. The movable clamping jaw 4 comprises a further bearing point 18 for the spring 5, so that the spring 5 is supported in a three-point bearing arrangement. The bearing point 18 is preferably arranged in the area of the rotation axis 6 of the movable clamping jaw 4. The leaf spring 5 is thus fixed in the gripper head 1 simply by the bearing point 18 or the configuration especially of the movable clamping jaw 4. According to the present illustration, the spring 5 extends nearly over the entire length of the gripper head 1. For adjusting the pre-tension of the spring 5, an eccentric cam 19 is provided, which forms the bearing point 18" on the stationary clamping jaw 3. The eccentric cam 19 can be adjusted by means of an adjusting screw 20 (compare FIG. 1). In order to further support a flat structural configuration of the gripper head 1, the movable clamping jaw 4, on the bottom side, comprises a recess 21 for receiving the spring 5. The recess 21 can also be embodied as a through-opening and extend up to the top side of the movable clamping jaw 4, and form the bearing point 18' for the spring 5 simply in the front area of the movable clamping jaw 4. Hereby the weight of the gripper head 1 can be further reduced.

As can be further seen in FIG. 1, the gripper head 1 comprises a guide element 22 by which it is guided at least in the horizontal direction on a weaving reed 23 of the weaving machine. In the vertical direction (compare FIG. 2) on the other hand, the gripper head 1 is guided floatingly on the bottom warp threads 13. If no beating-up of the weft material by a weaving reed 23 is necessary due to the insertion of the band-shaped weft material 8 close to the interlacing point 12, nonetheless a corresponding weaving reed-like element can be used in an advantageous manner as a guide surface 23 of the gripper head 1. According to a further embodiment of the invention, which is not illustrated here, the gripper head 1 can be guided by means of the guide element 22 exclusively on the weaving reed 23 (or respectively the guide surface 23) at least between the cloth edges. In this regard, the weaving reed 23 and the guide element 22 are guided within one another in a form-fitting manner such that also a vertical supporting of the gripper head 1 on the weaving reed 23 is possible. For example a dovetail guide is conceivable.

The frame 10 furthermore comprises securing bores 15 for securing a gripper rod. In this regard, in a known manner, a toothed gear rod, a pipe or also a band can be provided as the gripper rod. Due to the securing of the gripper rod on the frame 10, it is possible to arrange the gripper rod, which requires a comparatively large structural space, close to the weaving reed 23 in the larger opening area of the loom shed.

The invention is not limited to the illustrated example embodiments. Derivations and combinations of the various features in the scope of the patent claims are similarly encompassed by the invention.

REFERENCE CHARACTER LIST 1 gripper head
2 clamping device
3 stationary clamping jaw
4 movable clamping jaw
5 spring, leaf spring
6 rotation axis
7 clamping surfaces
8 band-shaped weft material
9 control means
10 perimeter frame
11 bearing arrangement
12 interlacing point
13 warp threads
14 longitudinal contour
15 securing bores
16 actuating surface
17 recess
18 bearing point
19 eccentric cam
20 adjusting screw
21 recess
22 guide element
23 weaving reed, guide surface
24 bearing bushing
25 bearing bolt or stud
B clamping width
BR motion direction of the gripper head
H structural height
$\alpha$ opening angle

The invention claimed is:

1. A gripper head (1) of a weaving machine with a clamping device (2) configured and adapted to clamp a band-shaped weft material (8) to be inserted into a loom shed of the weaving machine, wherein the clamping device (2) comprises a stationary clamping jaw (3) and a movable clamping jaw (4) that is loaded by a spring (5) and movable about a rotation axis (6), each clamping jaw respectively having a clamping surface (7), and wherein the movable clamping jaw (4) is actuatable by a control device to open the clamping device (2), characterized in that the gripper head (1) comprises a perimeter frame (10), wherein the clamping surfaces (7) are arranged essentially outside of the frame (10) and in the warp direction laterally next to the frame (10) on protruding collars (3*a*, 4*a*) of the clamping jaws (3, 4), which extend outside of the frame (10) perpendicularly to the motion direction (BR) of the gripper head (1) in a direction toward the interlacing point (12), and the spring (5) and the rotation axis (6) are arranged inside the frame (10).

2. The gripper head according to claim 1, characterized in that the protruding collars (3*a*, 4*a*), at least at their end facing toward the interlacing point (12), comprise a reduced height (H') relative to the height (H) of the frame (10).

3. The gripper head according to claim 2, characterized in that the protruding collars (3*a*, 4*a*) comprise an essentially triangle-shaped contour in the warp direction.

4. The gripper head according to claim 3, characterized in that the contour of the protruding collars (3*a*, 4*a*) and/or of the gripper head (1) is adapted or fitted to an opening angle (α) of the loom shed.

5. The gripper head according to claim 1, characterized in that the frame (10) is closed on its front end with respect to the motion direction (BR) of the gripper head (1).

6. The gripper head according to claim 1, characterized in that the frame (10) is formed by the stationary clamping jaw (3), and the movable clamping jaw (4) is supported in the interior of the frame (10).

7. The gripper head according to claim 1, characterized in that the movable clamping jaw (4) is arranged completely inside of a longitudinal contour (14) of the frame (10) when the clamping device (2) is closed.

8. The gripper head according to claim 1, characterized in that the frame (10) is embodied as a warp deflector.

9. The gripper head according to claim 1, characterized in that the frame (10) comprises securing bores (15) for securing a gripper rod.

10. The gripper head according to claim 1, characterized in that the movable clamping jaw (4) is embodied as a one-armed lever.

11. The gripper head according to claim 1, characterized in that the movable clamping jaw (4), on its front end, comprises an actuating surface (16) for the control device, which is a control rail.

12. The gripper head according to claim 11, characterized in that the frame (10) comprises a recess (17), through which the actuating surface (16) of the movable clamping jaw (4) is actuatable by the control device (9).

13. The gripper head according to claim 12, characterized in that the movable clamping jaw (4) is actuatable essentially directly on its front end by the control device (9).

14. The gripper head according to claim 1, characterized in that the movable clamping jaw (4) is loaded by a leaf spring (5), which is supported loosely in the frame (10).

15. The gripper head according to claim 14, characterized in that the leaf spring (5) is supported in a three-point bearing arrangement, wherein a central bearing point (18) of the three-point bearing arrangement is arranged on the movable clamping jaw (4) in a rotation axis (6) of the movable clamping jaw (4).

16. The gripper head according to claim 14, characterized in that the movable clamping jaw (4), on the bottom side, comprises a recess (17) for the leaf spring (5).

17. The gripper head according to claim 1, characterized in that the pre-tension of the spring (5) is adjustable by an eccentric cam (19).

* * * * *